US006140774A

United States Patent [19]

Mori et al.

[11] Patent Number: 6,140,774

[45] Date of Patent: Oct. 31, 2000

[54] PLANAR TYPE PLASMA DISCHARGE DISPLAY DEVICE AND DRIVE METHOD

[75] Inventors: Hiroshi Mori; Hironobu Abe, both of Kanagawa, Japan

[73] Assignee: Sony Corporation, Tokyo, Japan

[21] Appl. No.: 09/413,881

[22] Filed: Oct. 7, 1999

[30] Foreign Application Priority Data

Oct. 9, 1998 [JP] Japan ..... 10-288237

[51] Int. Cl.[7] ..... G09G 3/10

[52] U.S. Cl. ..... 315/169.4; 315/169.1; 313/494; 313/491

[58] Field of Search ..... 315/169.4, 169.1, 315/169.2; 313/494, 491, 582–584, 268; 345/60, 41, 84, 87

[56] References Cited

U.S. PATENT DOCUMENTS

| | | | |
|---|---|---|---|
| 3,811,061 | 5/1974 | Nakayama | 313/109.5 |
| 4,628,228 | 12/1986 | Geffcken et al. | 315/169.4 |
| 5,276,384 | 1/1994 | Martin | 313/582 |
| 5,306,984 | 4/1994 | Lee | 313/484 |
| 5,317,231 | 5/1994 | Lee | 313/493 |
| 5,471,112 | 11/1995 | Hamon et al. | 313/485 |

FOREIGN PATENT DOCUMENTS

| | | |
|---|---|---|
| 0 936 655 | 8/1999 | European Pat. Off. . |
| WO 96/20494 | 7/1996 | WIPO . |

*Primary Examiner*—Haissa Philogene
*Attorney, Agent, or Firm*—Ronald P. Kananen; Rader, Fishman & Grauer

[57] ABSTRACT

A first electrode group and a second electrode group each being formed by planarly arraying a plurality of electrodes on a common substrate are arrayed such that the electrodes cross over through an insulating layer. A common discharge electrode portion is arranged between each pair of adjacent electrodes of the first electrode group to be opposite to the pair of electrodes, and plasma discharge portions are formed at opposing portions of the respective discharge electrode portions and the opposite portions of each of the pairs of electrodes opposite to the discharge electrode portions. Thus, a problem of decreases in width of electrodes and inter-electrode interval caused by an increase in definition in a planar-type plasma discharge display device is solved, and at the same time, without using a complex signal processing circuit, the display drive of the planar-type plasma discharge display device and a high-luminance display drive are performed without causing any image degradation.

14 Claims, 15 Drawing Sheets

PLANAR TYPE PLASMA DISCHARGE DISPLAY DEVICE AND DRIVE METHOD

BACKGROUND OF THE INVENTION

1. Field of the Invention

The present invention relates to a planar-Type plasma discharge display device and a drive method.

2. Description of the Related Art

In general, as a planar-type plasma discharge display device which employs a so-called matrix display manner of a two-electrode type, which has first and second electrode groups respectively formed by arraying a plurality of parallel electrodes called X electrodes and a plurality of parallel electrodes called Y electrodes, and which performs a target display by a plasma discharge between selected electrodes of both the electrode groups, a plasma panel disclosed in Japanese Unexamined Patent Publication No. 6-52802 is known.

In the conventional two-electrode type planar-type plasma discharge display device, whose schematic sectional view is shown in FIG. 11, for example, first and second substrates 51 and 52 each constituted by, e.g., a glass substrate, are opposite to each other with a required interval to interpose a partition wall 53 therebetween, and the peripheral portions of the first and second substrates are sealed by a glass frit or the like (not shown).

For example, a first electrode group 61 formed by arraying a plurality of parallel electrodes is formed on the inner surface of the first substrate 51, and a second electrode group 62 is formed on the inner surface of the second substrate 52 to be perpendicular to the electrodes of the first electrode group 61.

A dielectric layer 54 is stacked on the electrode groups 61 and 62 of both the substrates 51 and 52 by printing or the like, and a surface protecting film (not shown) such as MgO or the like is formed on the surface of the dielectric layer.

A phosphor layer 55 which will emit a visible light by ultraviolet rays generated by discharge is coated on each discharge spatial region constituted by each of the partition walls 53.

In the conventional, general planar-type plasma discharge display device described above, the first and second electrode groups are formed on different substrates, i.e., the first and second substrates 51 and 52, respectively.

Therefore, the setting precision of the positional relationship between the first and second electrode groups is dependent on the precision in forming the electrode groups on the respective plates and the positional relationship between both the plates in joint sealing of the plates. Therefore, at the respective portions, in setting of uniform intervals and positional relationships, the following problems are posed. That is, a high precision cannot be easily obtained, assembling of the planar-type plasma discharge display device requires special attention, and the operability and the yield of planar-type plasma discharge display devices deteriorate.

The present applicant proposed a planar-type plasma discharge display device which attempts to solve the above problems as a "planar-type plasma discharge display device" applied in Japanese Patent Application No. 10-32981.

The schematic perspective view of the planar-type plasma discharge display device is shown in FIG. 12, and the exploded cutaway view of a main part of the planar-type plasma discharge display device is shown in FIG. 13. As shown therein, first and second substrates 1 and 2 are opposite to each other with a required interval, and the peripheral portions of the first and second substrates are frit-sealed to obtain a planar-type structure which is airtightly sealed.

In this display device, first and second substrates 11 and 12 respectively constituted by a plurality of electrodes X ($X_1$, $X_2$, $X_3$, . . . ) and a plurality of electrodes Y ($Y_1$, $Y_2$, $Y_3$, . . . ) are arranged on a common substrate 1.

Terminals $T_X$ ($T_{X1}$, $T_{X2}$, $T_{X3}$, . . . ) led from the electrodes X ($X_1$, $X_2$, $X_3$, . . . ) and terminals $T_Y$ ($T_{Y1}$, $T_{Y2}$, $T_{Y3}$, . . . ) led from the electrodes Y ($Y_1$, $Y_2$, $Y_3$, . . . ) are formed such that the end portions of the electrodes X ($X_1$, $X_2$, $X_3$, . . . ) and electrodes Y ($Y_1$, $Y_2$, $Y_3$, . . . ) are led to sides e.g., two side projecting from the first substrate 1 and the second substrate 2.

The first electrode group 11 is formed on the first substrate 1 by planarly arraying a plurality of belt-like parallel electrodes X ($X_1$, $X_2$, $X_3$, . . . ) which extend along one direction, e.g., a row direction and which are arrayed with a required interval, as shown in FIG. 14 as a plan view of a main part of an example.

While, the second electrode group 12 is constituted by electrodes Y ($Y_1$, $Y_2$, $Y_3$, . . . ) constituted by, e.g., belt-like electrode portions $A_Y$ ($A_{Y1}$, $A_{Y2}$, $A_{Y3}$, . . . ) extending along a column direction which crosses or is perpendicular to the extending direction of the electrodes X ($X_1$, $X_2$, $X_3$, . . . ) and discharge electrode portions $I_Y$.

Under these belt-like electrode portions $A_Y$, insulating layers 14 consisting of, e.g., $SiO_2$ are adhesively formed in the forms of belts in a column direction to traverse the row electrodes X, so that the electrode portions are electrically insulated from the row electrodes X, respectively.

The discharge electrode portions $I_Y$ are constituted by discharge electrode portions $I_{Y11}$, $I_{Y12}$, $I_{Y13}$, . . . , $I_{Y21}$, $I_{Y22}$, $I_{Y23}$, . . . , $I_{Y31}$, $I_{Y32}$, $I_{Y33}$, . . . which are arranged to extend between adjacent electrodes $X_1$ and $X_2$ and adjacent electrodes $X_2$ and $X_3$, . . . from one side of the electrode portions $A_Y$ ($A_{Y1}$, $A_{Y2}$, $A_{Y3}$, . . . ), i.e., left side in FIG. 14, and which are opposite to the electrodes X with a required narrow interval d, respectively.

In FIG. 14, the first electrode group 11 and the discharge electrode portions $I_Y$ of the second electrode group 12 are simultaneously formed out of the same conductive layer. In formation of the electrode portions $A_Y$ of the second electrode group 12, connection pieces 15 are formed to laterally extend from the respective electrode portions $A_Y$ ($A_{Y1}$, $A_{Y2}$, $A_{Y3}$, . . . ). These connection pieces 15 are brought into direct contact with the corresponding discharge electrode portions $I_Y$ ($I_{Y11}$, $I_{Y12}$, $I_{Y13}$, . . . , $I_{Y21}$, $I_{Y22}$, $I_{Y23}$, . . . , $I_{Y31}$, $I_{Y32}$, $I_{Y33}$, . . . ) to be electrically connected to the discharge electrode portions.

FIG. 15 typically shows the relationship between the arrangements of the first and second electrode groups 11 and 12 having the above configuration. More specifically, in this configuration, plasma discharge portions P ($P_{11}$, $P_{12}$, $P_{13}$, . . . , $P_{21}$, $P_{22}$, $P_{23}$, . . . , $P_{31}$, $P_{32}$, $P_{33}$, . . . ) are formed between the discharge electrode portions $I_Y$ ($I_{Y11}$, $I_{Y12}$, $I_{Y13}$, . . . , $I_{Y21}$, $I_{Y22}$, $I_{Y23}$, . . . , $I_{Y31}$, $I_{Y32}$, $I_{Y33}$, . . . ) and the electrodes X ($X_1$, $X_2$, $X_3$, . . . ) which are opposite to one side thereof.

The planar-type plasma discharge display device having the configuration described above solves the above problems by arranging both the first and second electrode groups 11 and 12 on the common substrate.

In recent years, as the performance of displays used in considerably advanced personal computers, office workstations, or hang-up type televisions or the like, a further increase in definition is required.

In order to increase the number of pixels to achieve the increase in definition, the intervals between the electrodes are narrowed, or the widths of electrodes are reduced. However, in this case, unless there exists high precision in the manufacturing time, a decrease in productivity or a decrease in yield occurs. Additional problems such as generation of discharge at an unnecessary portion in a product, degradation of reliability caused by a decrease in withstand voltage, a response speed caused by an increase in resistance of an electrode, and the like may occur.

SUMMARY OF THE INVENTION

The present invention solves the problems as described above. More specifically, according to the present invention, a high-definition, high-quality planar-type plasma discharge display device is proposed wherein the widths of the electrodes and the intervals between the electrodes are kept to be a required width and a required interval, wherein degradation of productivity or decrease in yield are avoided by maintaining a high precision in the manufacturing time described above. In addition, the problems, of discharge generation discharge at an unnecessary portion in a product, degradation of reliability caused by a decrease in withstand voltage, degradation of a response speed caused by a decrease in resistance of an electrode, and the like are solved.

The present invention drives a display without using complex signal processing circuitry and without any image degradation.

The present invention drives a display making it possible to achieve a high-luminance display.

According to an aspect of the present invention, there is provided a planar-type plasma discharge device, in which first and second electrode groups each formed by planarly arraying a plurality of electrodes are planarly arranged on a common electrode such that an insulating layer is interposed between crossing portions of the electrodes.

A common discharge electrode portion is arranged at each electrode of the second electrode group such that a required narrow interval is maintained between each pair of adjacent electrodes of the first electrode group and the pair of electrodes to form plasma discharge portions at opposite portions between the discharge electrode portions and the pairs of electrodes, respectively.

According to another aspect of the present invention, there is provided a drive method for a planar-type plasma discharge display device in which to the planar-type plasma discharge display device arranged as described above, a target display is performed to apply a voltage which is equal to or higher than a discharge start voltage across the electrodes of the first electrode group and the discharge electrode portion of the second electrodes constituting a selected plasma discharge portion.

In the drive method in which one frame is constituted by first and second fields, when the target display is performed to apply the voltage which is equal to or higher than the discharge start voltage between the electrodes of the first electrode group and the discharge electrode portion of the second electrodes constituting the selected plasma discharge portion, a display by one plasma discharge portion of a pair of plasma discharge portions constituted by the discharge electrode portions is performed in the first field, and a display by the other plasma discharge portion of the pair of plasma discharge portions constituted by the discharge electrode portions is performed in the second field.

When the target display is performed to apply the voltage which is equal to or higher than the discharge start voltage between the electrodes of the first electrode group and the discharge electrode portion of the second electrodes constituting the selected plasma discharge portion in the planar-type plasma discharge display device arranged as described above, a pair of plasma discharge portions constituted by the discharge electrode portions are simultaneously subjected to a driving discharge to perform a display.

As described above, according to the present invention, it is found that, even in the configuration in which a so-called pair of discharge electrode groups constituted by the first and second electrode groups are planarly arrayed, plasma discharge for a display can be reliably generated by selecting the arrangement of the electrodes, an applied voltage, and the like. On the basis of this, a pair of discharge electrode groups are arrayed on a common substrate.

In the present invention, since a pair of plasma discharge portions are formed for one discharge electrode portion to reduce plasma discharge electrodes in number, the width of each electrode can be sufficiently held in an increase in number of pixels, i.e., an increase in number of plasma discharge portion.

In addition, in a drive of the planar-type plasma discharge display device, as will be apparent from the following description, the drive can be performed without using a special signal processing circuit and the like.

A high-luminance display can be performed by simultaneously turning on/off a pair of plasma discharge portions related to each discharge electrode portion.

DESCRIPTION OF THE PREFERRED EMBODIMENTS

Figure 1:
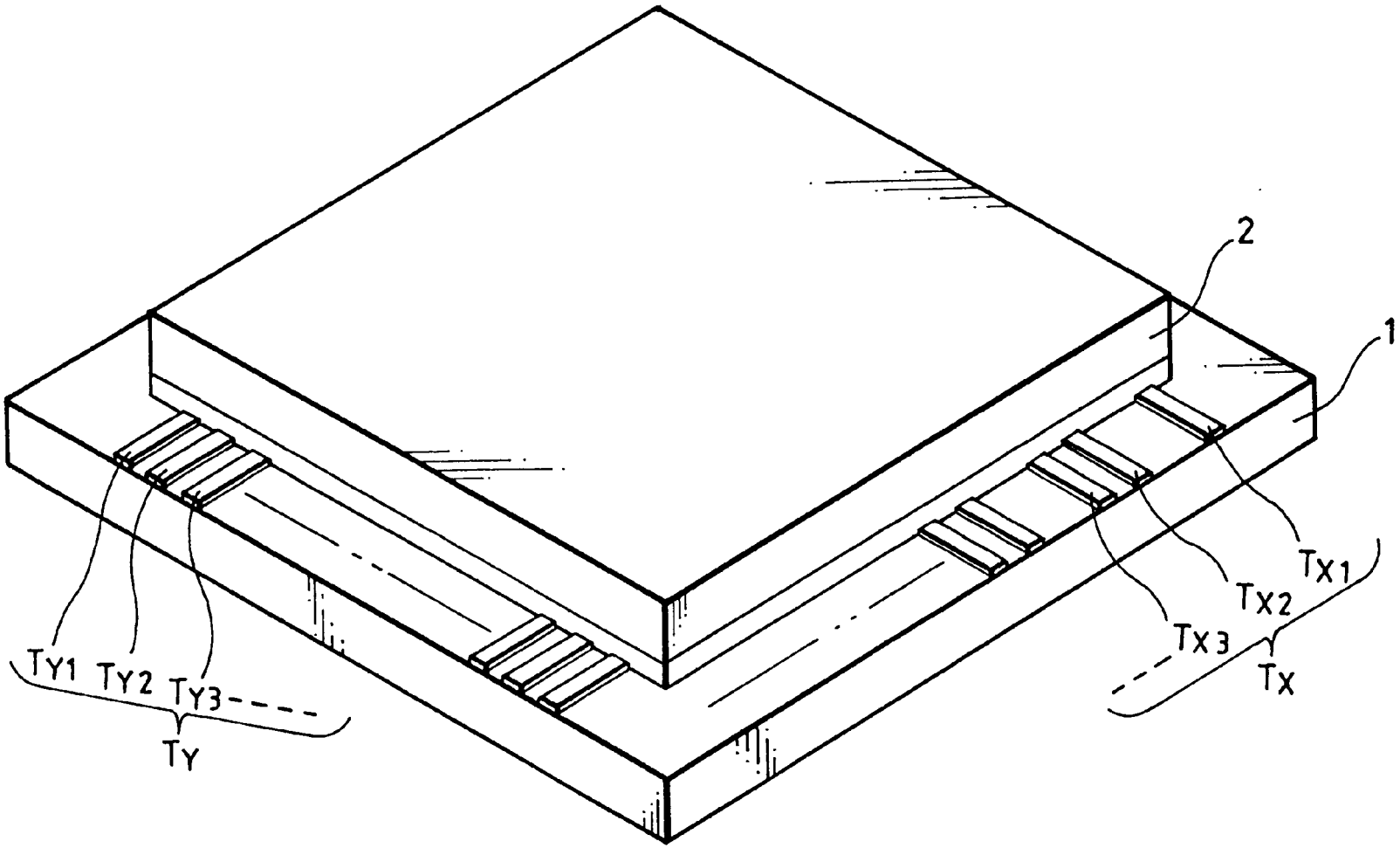
FIG. 1 is a perspective view of an example of a planar-type plasma discharge display device according to the present invention.
Figure 2:
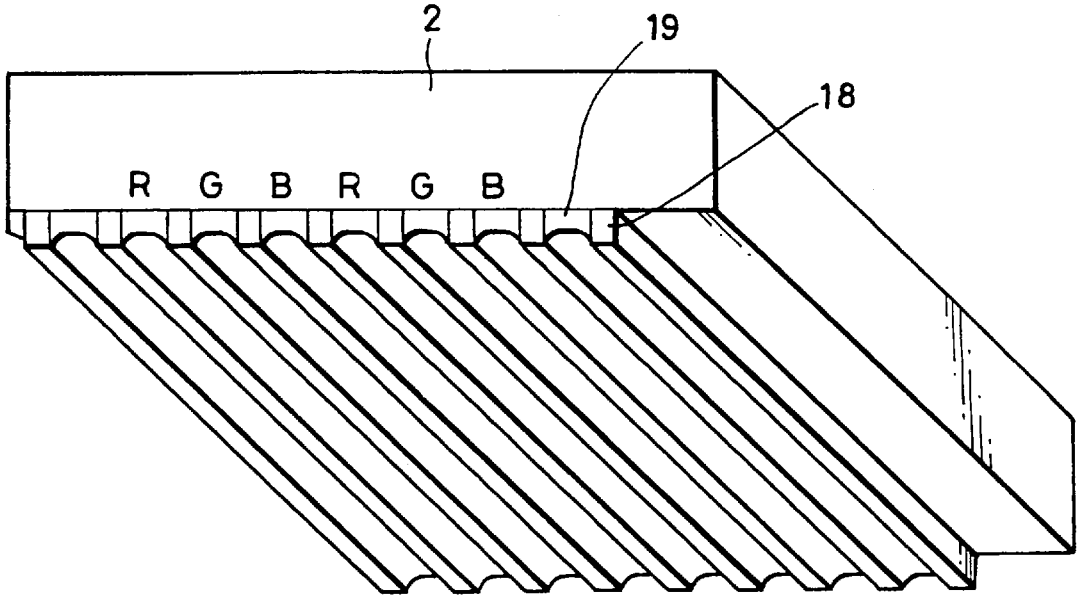
FIG. 2 is a partially cutaway open perspective view of an example of the planar-type plasma discharge display device according to the present invention.
Figure 2:
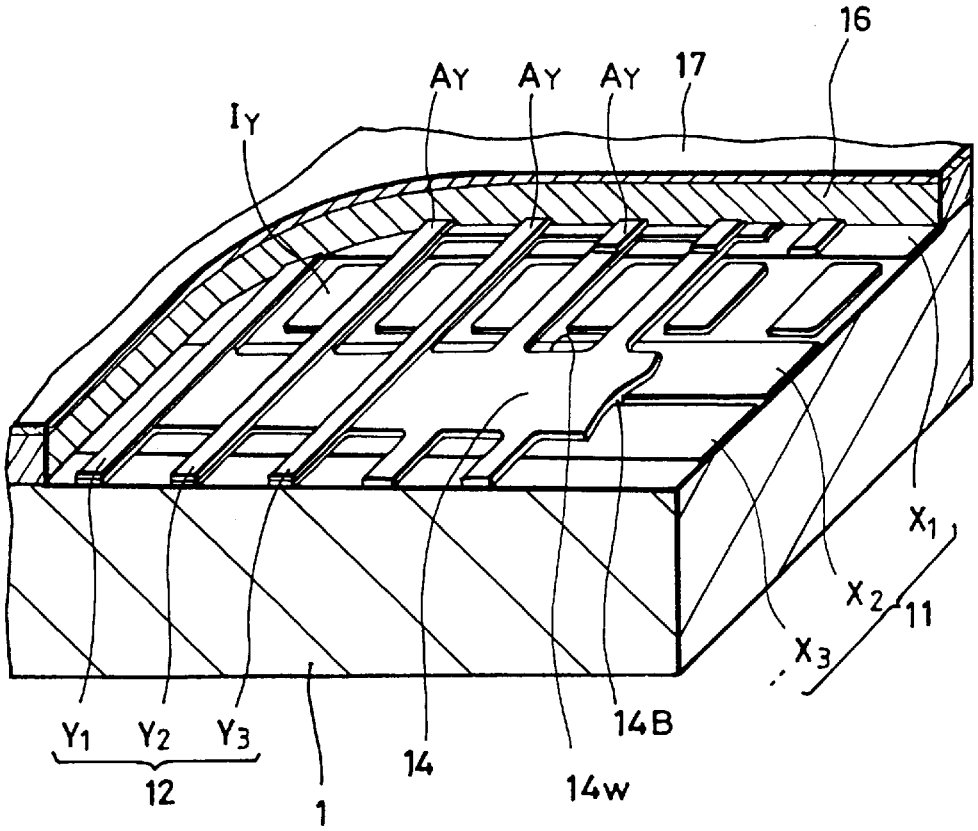

As shown in the schematic perspective view of one form of a planar-type plasma discharge display device according to the present invention in FIG. 1 and in the exploded perspective partially cutaway view of a main part of the planar-type plasma discharge display device in FIG. 2, first and second substrates 1 and 2 at least one of which is constituted by, e.g., a glass substrate transmitting a light are opposite to each other with a required interval. The peripheral portions of the first and second substrates are frit-sealed to be airtightly sealed, thereby constituting a planar-type display vessel in which a flat gas space is formed between both the substrates 1 and 2.

The flat gas space between both the substrates 1 and 2 is filled with a gas. As this filler gas may include, for example, one or more types of gases such as He, Ne, Ar, Xe, and Kr, for example, a gas mixture of Ne and Xe or a gas mixture of Ar and Xe, i.e., a so-called Penning gas.

The pressure of this gas can be set to be an atmospheric pressure of about 0.8 to 5.

In this display device, first and second electrode groups 11 and 12 respectively constituted by a plurality of electrodes X ($X_1$, $X_2$, $X_3$, . . . ) and a plurality of electrodes Y ($Y_1$, $Y_2$, $Y_3$, . . . ) are arranged on the common first substrate 1 such that an insulating layer 14 is interposed between at least crossing portions of the electrodes.

Terminals $T_X$ ($T_{X1}$, $T_{X2}$, $T_{X3}$, . . . ) led from the electrodes X ($X_1$, $X_2$, $X_3$, . . . ) and terminals $T_Y$ ($T_{Y1}$, $T_{Y2}$, $T_{Y3}$, . . . ) led from the electrodes Y ($Y_1$, $Y_2$, $Y_3$, . . . ) are formed such that the end portions of the electrodes X ($X_1$, $X_2$, $X_3$, . . . ) and electrodes Y ($Y_1$, $Y_2$, $Y_3$, . . . ) are led to sides, projecting sides of the first substrate 1 from the second substrate 2, e.g., as shown in FIG. 1. Two adjacent sides, otherwise, although not shown, one or both of the electrodes X and Y are alternately led from two opposite sides.

Figure 3:
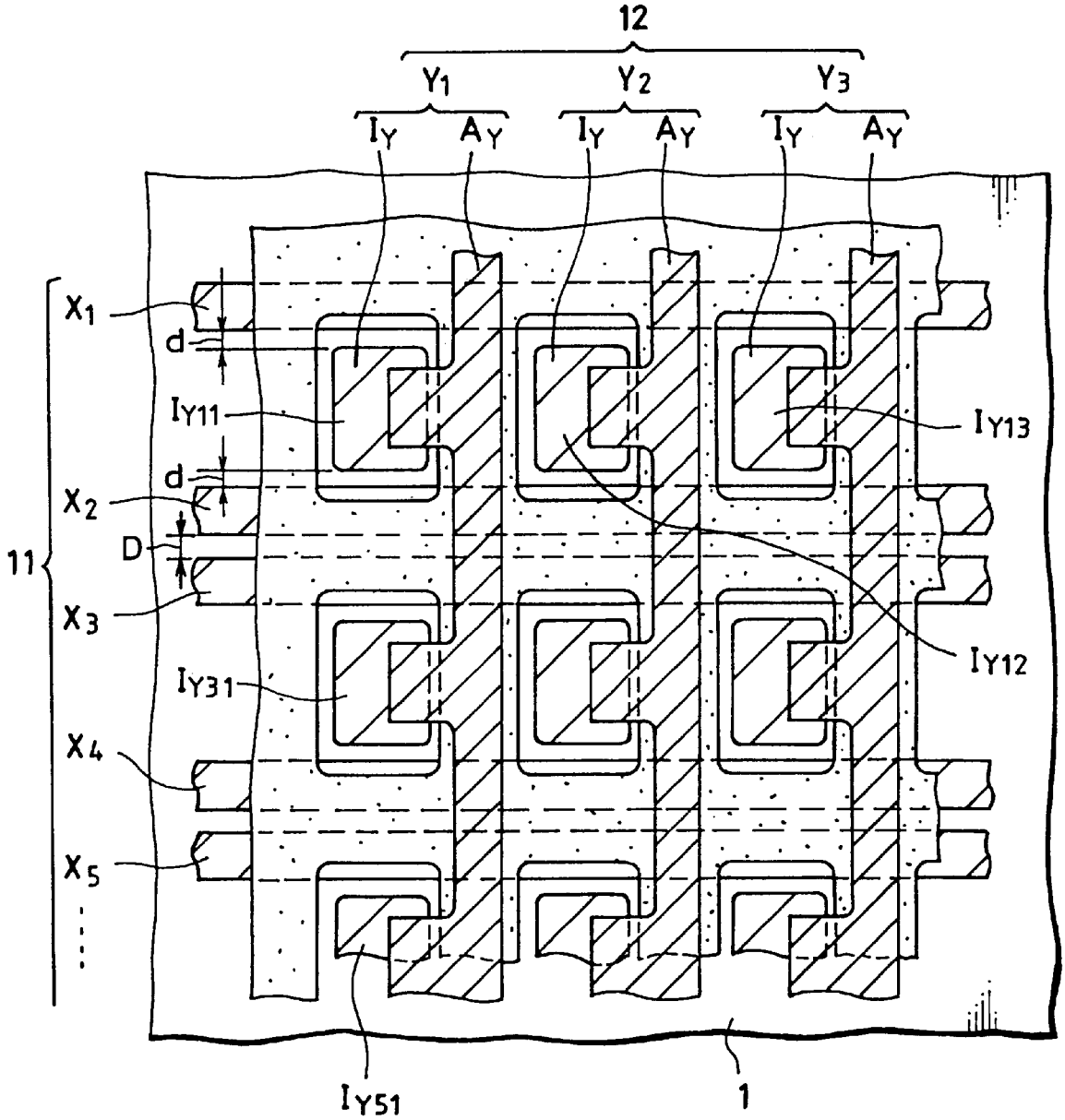
FIG. 3 is a plan view of a main part of a first substrate on which first and second electrode groups of an example of the planar-type plasma discharge display device according to the present invention are arranged.

As shown in FIG. 3, which is a plan view of a main part of the example, the first electrode group 11 is formed on the first substrate 1 by planarly arraying a plurality of belt-like parallel electrodes X ($X_1$, $X_2$, $X_3$, . . . ) which extend along one direction, e.g., a row direction.

The second electrode group 12 is constituted by electrodes Y ($Y_1$, $Y_2$, $Y_3$, . . . ) constituted by, e.g., belt-like electrode portions $A_Y$ ($A_{Y1}$, $A_{Y2}$, $A_{Y3}$, . . . ) extending along a column direction which crosses or is perpendicular to the extending direction of the electrodes X ($X_1$, $X_2$, $X_3$, . . . ) and discharge electrode portions $I_Y$.

Figure 14:
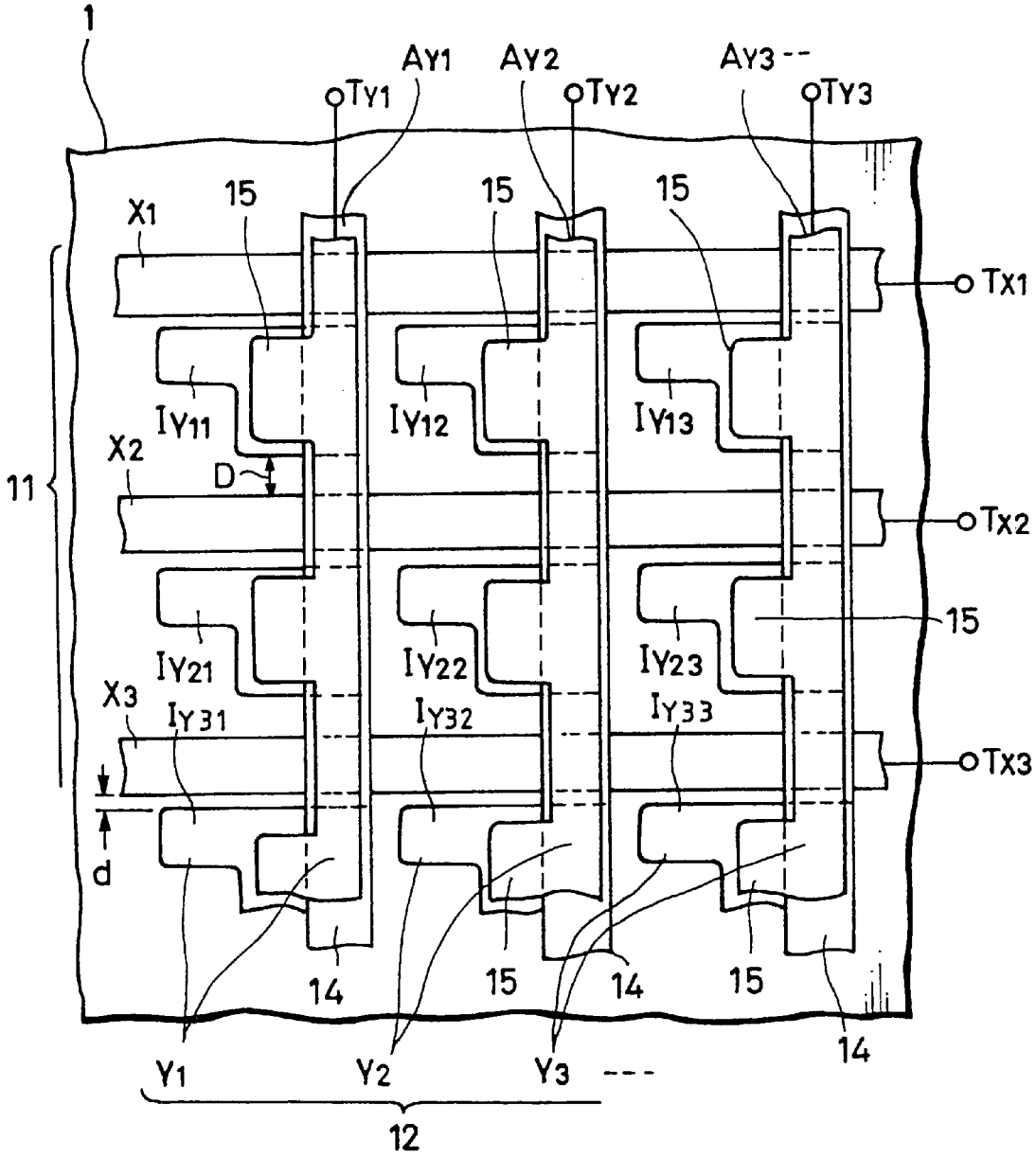
PRIOR ART FIG. 14
FIG. 14 is a plan view of a main part of the planar-type plasma discharge display device shown in FIG. 12.

The discharge electrode portions $I_Y$ are arranged from respective one sides of the electrode portions $A_Y$ ($A_{Y1}$, $A_{Y2}$, $A_{Y3}$, . . . ), i.e., left sides in FIG. 14. However, these discharge electrode portions $I_Y$ are constituted by $I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . which are respectively arranged between pairs of adjacent electrodes, i.e., between the electrodes $X_1$ and $X_2$, between the electrodes $X_3$ and $X_4$, between the electrodes $X_5$ and $X_6$, . . . , of respective pairs of the first electrode group X. More specifically, the discharge electrode portions $I_Y$ are not arranged between other pairs of adjacent electrodes, e.g., between the electrodes $X_2$ and $X_3$, between the electrodes $X_4$ and $X_5$, . . . .

Figure 4:
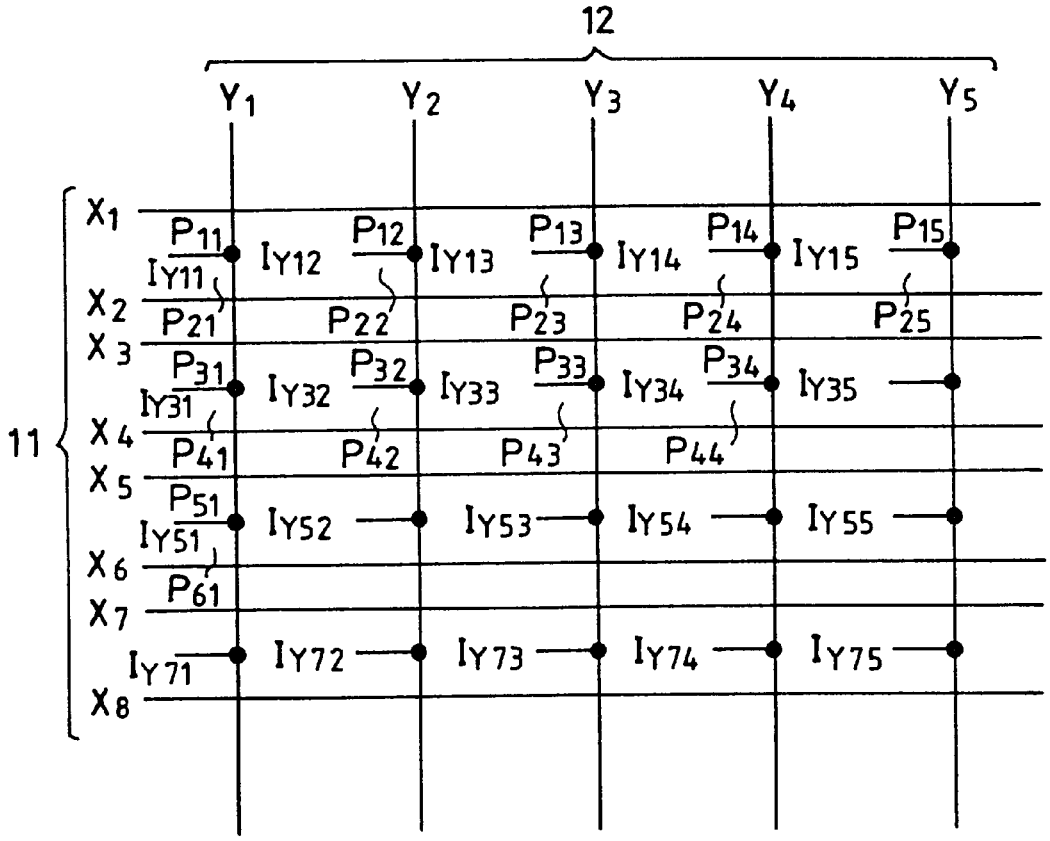
FIG. 4 is a schematic view of an electrode arrangement of the planar-type plasma discharge display device according to the present invention.
Figure 15:
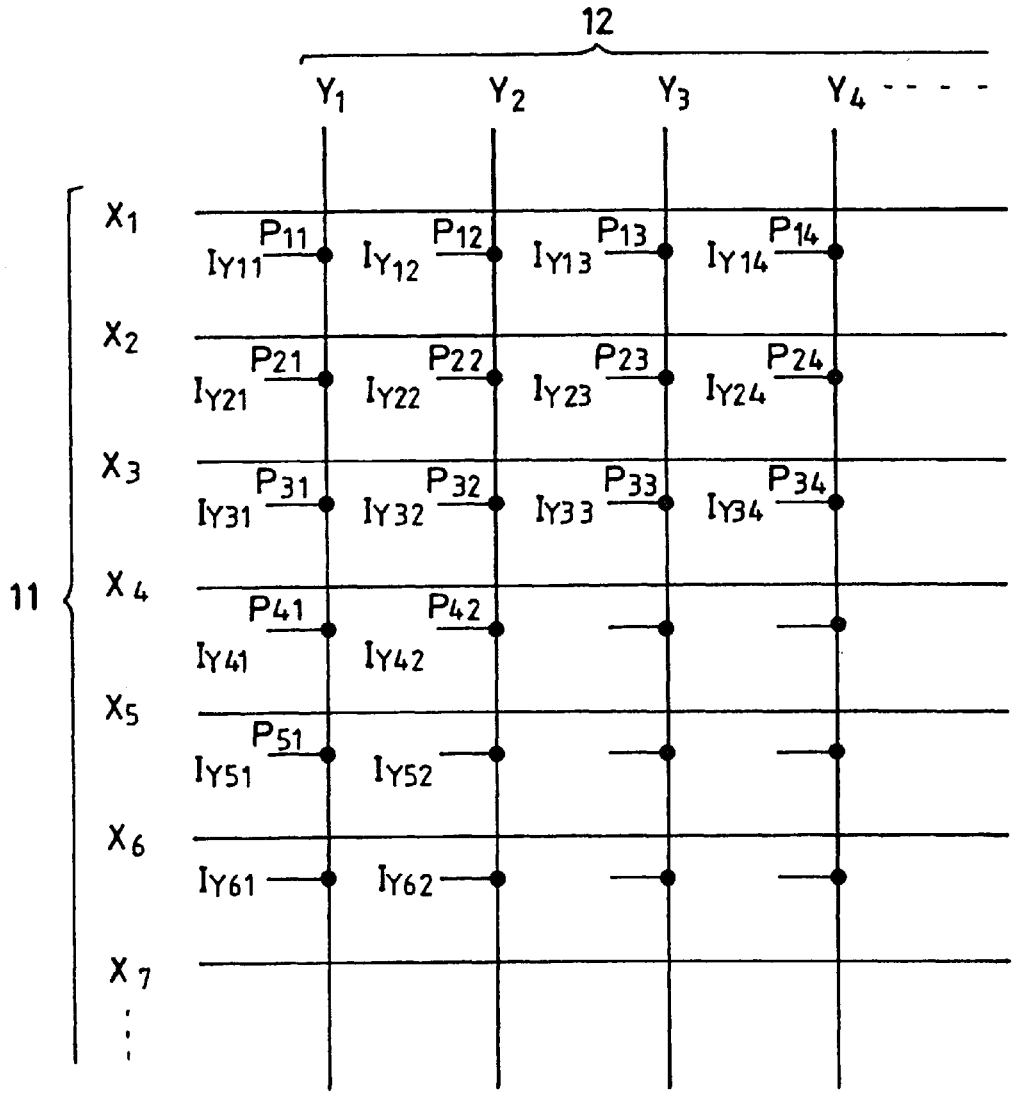
PRIOR ART FIG. 15
FIG. 15 is a schematic view of an electrode arrangement of the planar-type plasma discharge display device shown in FIG. 12.

More specifically, as shown in FIG. 4, which is a typical view of the arrangement of the first and second electrode groups 11 and 12, with this configuration, discharge electrode portions $I_{Y21}$, $I_{Y22}$, $I_{Y23}$, . . . , $I_{Y41}$, $I_{Y42}$, $I_{Y43}$, . . . described in FIG. 15 are excluded to decrease the number of discharge electrode portions $I_Y$ to ½.

The interval between the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) and the electrodes X opposing these electrode portions is set to a narrow interval d at which discharge is made by a required discharge start voltage. Plasma discharge portions P ($P_{11}$, $P_{12}$, $P_{13}$, . . . , $P_{21}$, $P_{22}$, $P_{23}$, . . . , $P_{31}$, $P_{32}$, $P_{33}$, . . . ) are formed on both the sides of the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) and at their portions opposing the electrodes X ($X_1$, $X_2$, $X_3$, . . . ) of the first electrode group.

An interval D between the adjacent electrodes $X_2$ and $X_3$, $X_4$ and $X_5$, . . . without interposing the discharge electrode portions $I_Y$ satisfies, e.g., D>d.

A partition wall insulation layer 14B having a height (thickness) which is equal to or larger than the interval D, i.e., which is equal to or exceeds the interval D is interposed between the other pairs of electrodes $X_2$ and $X_3$, $X_4$ and $X_5$, . . . , which are adjacent to each other without interposing the discharge electrode portions $I_Y$. In the illustrated example, the partition wall insulation layer 14B is formed by using the same layer as the insulating layer 14.

As described above, by the fact that the partition wall insulation layer 14B is interposed between the other pairs of electrodes $X_2$ and $X_3$, $X_4$ and $X_5$, . . . , which are adjacent to each other without interposing the discharge electrode portions $I_Y$, the danger of generating abnormal discharges from the discharge electrode portions $I_Y$ ($I_{Y11}$, $I_{Y12}$, $I_{Y13}$, . . . , $I_{Y21}$, $I_{Y22}$, $I_{Y23}$, . . . , $I_{Y31}$, $I_{Y32}$, $I_{Y33}$, . . . ) relative to the electrode ($X_1$, $X_2$, $X_3$, . . . ) of the other plasma discharge portions P can be more reliably avoided.

Phosphor layers 19 which will emit visible light by vacuum ultraviolet rays or ultraviolet rays generated by plasma discharge are formed on the second substrate 2 as shown in FIG. 2. When a color display is made, for example, phosphors R, G, and B which will emit color lights of red, green, and blue.

On the second substrate 2 on which the phosphor layers 19 are formed, belt-like partition walls 18 are projectively formed in opposing relation to the respective electrode portions $A_Y$ ($A_{Y1}$, $A_{Y2}$, $A_{Y3}$, . . . ) of the electrodes Y ($Y_1$, $Y_2$, $Y_3$, . . . ) of the second electrode group 12 along the electrode portions $A_Y$ ($A_{Y1}$, $A_{Y2}$, $A_{Y3}$, . . . ). The partition walls 18 are used to prevent mutinal crosstalk between respective unit discharge regions, i.e., the plasma discharge portions P.

In this manner, in a selected plasma discharge portion P, a required DC or AC voltage is applied across the electrodes X of the first electrode group 11 and the discharge electrode portions $I_Y$ of the second electrode group 12 constituting the plasma discharge portion P to selectively cause discharge, and a required portion of the phosphor layers 19 is caused to emit a light, so that a target display is performed.

In an AC drive, a dielectric layer 16 is formed to cover the forming portion of at least the first or second electrode group.

On the dielectric layer 16, a surface layer 17 which has a work function smaller than that of the dielectric layer 16 and which protects the surface of the dielectric layer 16 from damage by sputtering caused by discharge plasma is formed as needed.

In order to easily understand the display device having the above configuration, a method of manufacturing the display device will be described below. By this example, the electrodes X of the first electrode group 11 and the discharge electrode portions $I_Y$ of the second electrode group 12 are formed with the same conductive layer, i.e., by the same steps.

Figure 5:
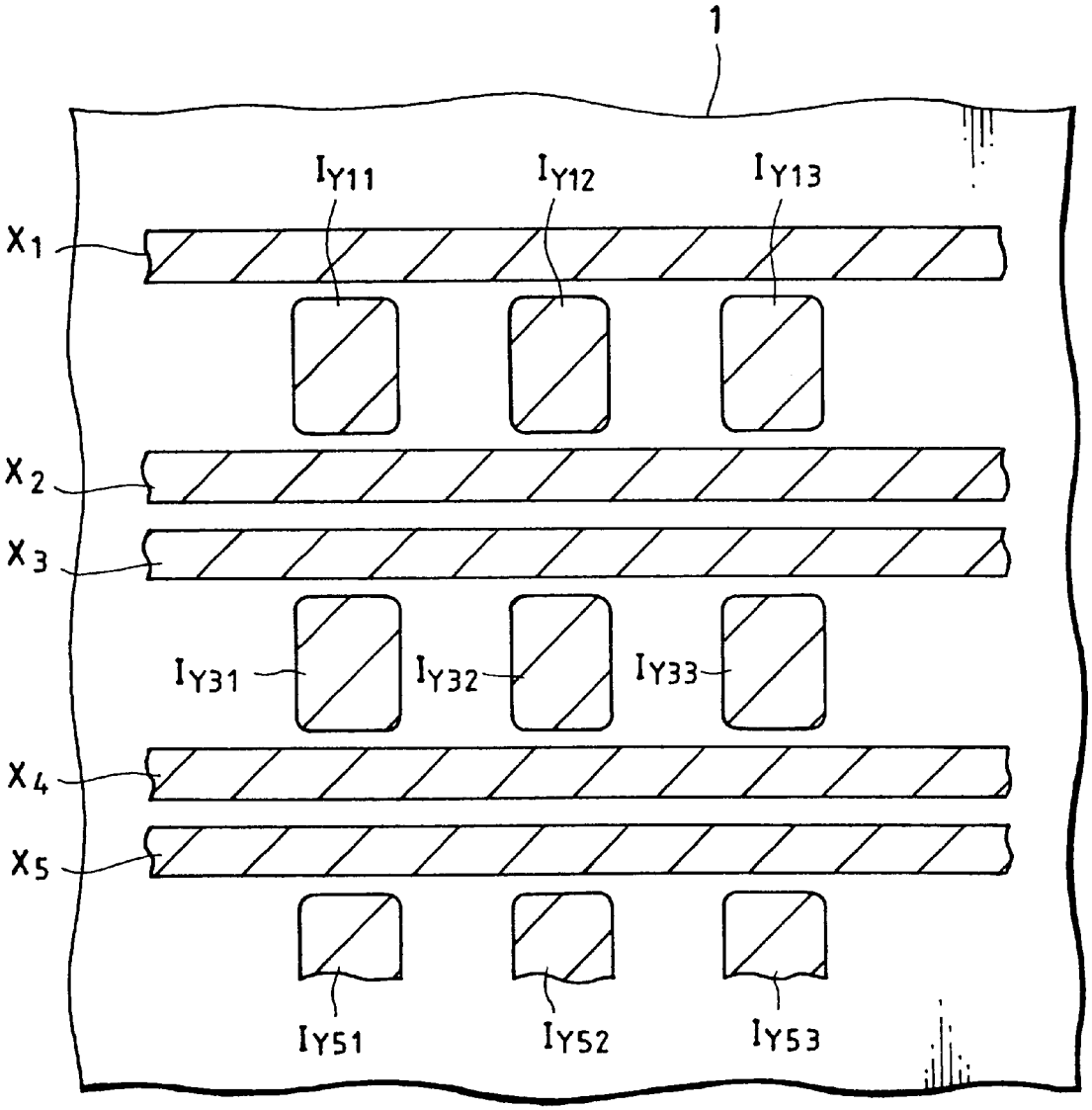
FIG. 5 is a plan view in one step of a manufacturing method of an example of the planar-type plasma discharge display device according to the present invention.

First, manufacturing steps related to the first substrate 1 will be described. As shown in FIG. 5, the first substrate 1 constituted by, for example, a glass substrate is prepared, the electrodes X ($X_1$, $X_2$, $X_3$, . . . ) of the first electrode group 11 and the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) of the electrodes Y ($Y_1$, $Y_2$, $Y_3$, . . . ) of the second electrode group 12 are formed on one major surface of the first substrate 1.

These electrodes X and the discharge electrode portions $I_Y$ can be formed by a lift-off method using, e.g., a photoresist layer. More specifically, although not shown, a photoresist layer is entirely coated on the substrate 1, and the photoresist layer is subjected to a pattern exposure and a development process to form openings in the forming portions of the electrodes X and the discharge electrode portions $I_Y$ which are finally formed from which the photoresist layer is removed, and a conductive layer is formed on the entire surface of the substrate 1 by, e.g., vapor deposition.

This conductive layer can be constituted by a transparent conductive layer, such as indiumtin-oxide (ITO) a metal layer consisting of one or more types of metals such as Al, Cu, Ni, Fe, Cr, Zn, Au, Ag, Pb and so on, or a conductive layer having a multi-layered structure consisting of Cr/Al having an Al layer and a surface layer such as a Cr layer, formed on the Al layer, for preventing oxidation of Al, a conductive layer having a multi-layered structure consisting of Cr/Al/Cr having, as a further lower layer thereof, or a lower layer constituted by, e.g., a Cr layer having excellent adhesiveness to a glass substrate.

Thereafter, the photoresist layer is removed, thereby removing the conductive layer formed on the photoresist, i.e., to lift off the conductive layer, and the remaining conductive layer to form the electrodes X ($X_1$, $X_2$, $X_3$, . . . ) and the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) shown in FIG. 5.

Figure 6:
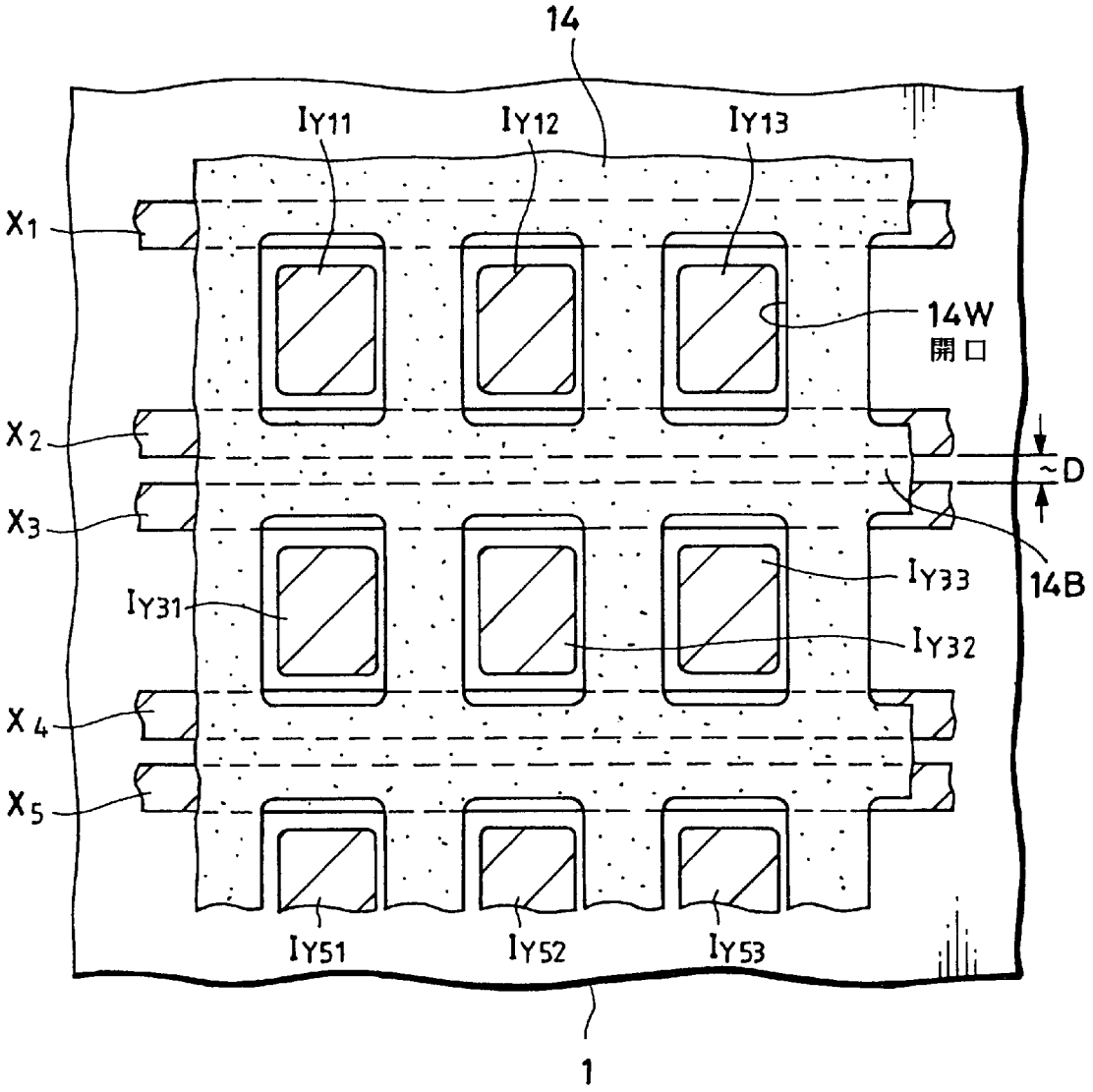
FIG. 6 is a plan view in one step of the manufacturing method of an example of the planar-type plasma discharge display device according to the present invention.

As shown in FIG. 6, formation of the insulating layer 14 is performed. The insulating layer 14 is formed on the forming portions of the electrode portions $A_Y$ of the second electrode group 12 on the first substrate 1, on a portion between the electrodes $X_2$ and $X_3$ which are adjacent to each other without interposing the discharge electrode portions $I_Y$, and on a portion between electrodes $X_4$ and $X_5$ which are adjacent to each other without interposing the discharge electrode portions $I_Y$ to have a lattice-like pattern in which openings 14W are formed in the forming portions of the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ). More specifically, this example is the case where the insulating layer portion and the partition wall insulation layer 14B which are interposed between the electrodes described above are integrally formed.

In the formation of the insulating layer 14, for example, a photosensitive glass paste constituting an insulating layer is coated on the entire surface of the first substrate 1, and is subjected to heat treatment at 80° C. for 20 minutes. Thereafter, the glass layer is subjected to a pattern exposure and a development process to form the lattice-like pattern described above. Thereafter, the lattice-like pattern is sintered at 600° C. to form the insulating layer 14.

As shown in FIG. 3, formation of the electrode portions $A_Y$ ($A_{Y1}$, $A_{Y2}$, $A_{Y3}$, . . . ) of the second electrode group 12 and connection pieces 15 extending therefrom is performed. As in this formation, formation by a lift-off method can be used. More specifically, as in this case, a photoresist layer is coated on the entire surface of the first substrate 1, the photoresist is subjected to a pattern exposure and a development process or is patterned. Thereafter, a conductive layer consisting of, e.g., Al is formed on the entire surface of the resultant structure by vapor deposition or the like, and the photoresist layer is peeled off to simultaneously form the electrode portions $A_Y$ ($A_{Y1}$, $A_{Y2}$, $A_{Y3}$, . . . ) and the connection pieces 15 extending therefrom.

In this manner, the first and second electrode groups 11 and 12 are formed.

Figure 7:
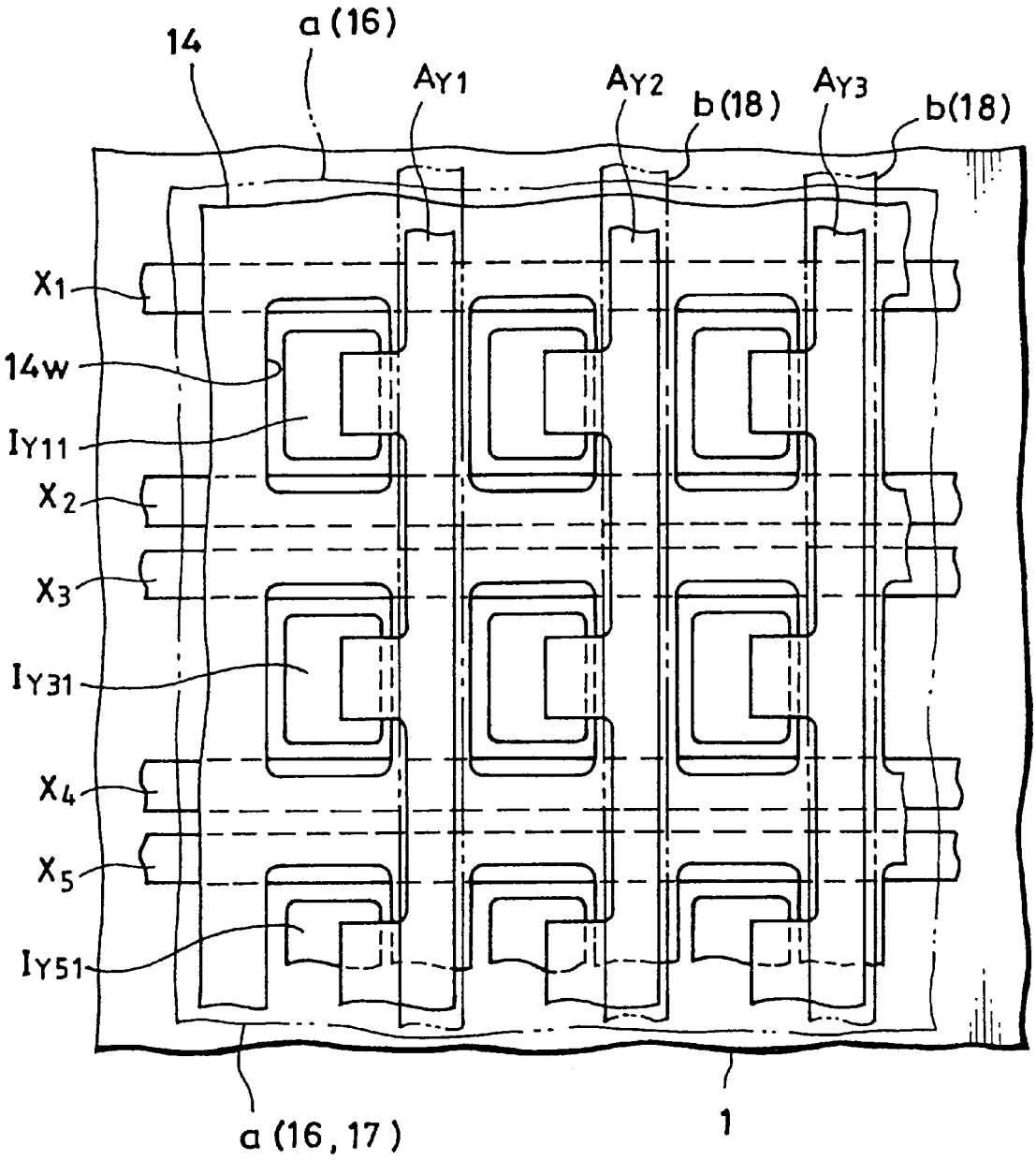
FIG. 7 is a plan view of a main part on a first substrate side of an example of the planar-type plasma discharge display device according to the present invention.

Thereafter, as indicated by chain line a in FIG. 7, and as shown in FIG. 2, the dielectric layer 16 consisting of $SiO_2$ or the like is entirely formed by a CVD (Chemical Vapor Deposition) method on the first substrate 1 except for the leading portions of the terminals such as $T_{X1}$, $T_{X2}$, $T_{X3}$, . . . and $T_{Y1}$, $T_{Y2}$, $T_{Y3}$, . . . constituted by the end portions of the electrodes X and Y, i.e., the outer peripheral portion of the first substrate 1, and the surface layer 17 consisting of MgO or the like shown in FIG. 2 is formed by, for example, the vapor deposition on the dielectric layer 16.

Next, manufacturing steps related to the second substrate 2 will be described. As in this case, the second substrate 2 constituted by, e.g., a glass substrate is prepared. The partition walls 18 shown in FIG. 2 are formed on one major surface of the second substrate 2. In the formation of the partition walls 18, for example, a laminate glass material sheet such as a green sheet (tradename available from Du Pont corporation) is stuck to the entire inner surface of the substrate 2, and is pre-baked at 210° C. or 410° C.

Thereafter, a photoresist layer is coated and subjected to a pattern exposure and a development process to remove portions of the photoresist layer other than the portions for forming the partition walls 18, i.e., the pattern of the partition walls 18.

Powder beam working or a so-called sand blasting process is performed by using the photoresist layer as a mask to remove portions of the glass material sheet other than the forming portions of the photoresist layer.

Thereafter, the photoresist is removed, and the resultant product is subjected to a sintering process at 600° C., for example. In this manner, the partition walls 18 are formed.

On the inner surface of the second substrate 2 on which the stripe-shaped partition walls 18 are formed as described above, red, green, and blue phosphors R, G, and B are sequentially formed on every third recessed portion between the partition walls 18, and are sintered at, e.g., 430° C. to form the phosphor layers 19.

The first substrate 1 on which the first and second electrode groups 11 and 12 are formed as described above and the second substrate 2 on which the partition walls 18 and the phosphor layers 19 are formed as described above are opposite to each other with a required interval such that the electrode portions $A_Y$ of the electrodes Y of the second electrode group 12 are correctly opposite to the partition walls 18 of the second substrate 2 respectively and such that the stripe-shaped phosphors R, G, and B are opposite to plasma discharge portions on the same vertical line. The peripheries of the first substrate 1 and the second substrate 2 respectively are sealed by a glass frit such that heat treatment at 430° C. is performed.

As frit positions in this case, positions where the terminal portions $T_X$ and $T_Y$ of the respective electrodes are led out of the structure.

In this case, as indicated by a chain line b in FIG. 7, the forming positions of the partition walls 18 are selected such that the partition walls 18 are opposite to the electrode portions $A_Y$ ($A_{Y1}$, $A_{Y2}$, $A_{Y3}$, . . . ) of the electrodes Y ($Y_1$, $Y_2$, $Y_3$, . . . ). However, the position setting does not require high precision.

In a state in which the insides of the flat spaces formed between the first and second substrates 1 and 2 are heated to, e.g., 380° C., an exhausting process is performed for two hours. The gas described above is filled in the flat spaces at a required gas pressure. In this manner, a planar-type plasma discharge display device according to the present invention is constituted.

The first and second electrode groups 11 and 12 are formed on the common substrate 1 as described above, and the insulating layer 14 is interposed between the crossing portions of the electrodes X and Y of the electrode groups 11 and 12 to electrically insulate the electrodes X and Y from each other.

Since the insulating layer 14 is present on the portions between the adjacent electrodes $X_2$ and $X_3$ and the adjacent electrodes $X_4$ and $X_5$, crosstalk is further prevented.

When the high-temperature treatment as described above is performed after the electrode groups of the lower layer, in this example, the first and second electrode groups 11 and 12 are formed. If the conductive layer, i.e., in the example described above, the electrodes X of the first electrode group 11 and the discharge electrode portions $I_Y$ of the electrodes Y of the second electrode group 12 are made of Al, characteristic degradation such as oxidation of Al may disadvantageously occur. In this case, as described above, a multi-layered structure in which Cr which protects Al and forms a stable poor conductor layer by oxidation is formed as a conductive layer is preferably formed.

In the method described above, each of the electrode groups 11 and 12 is formed by the lift-off method. However, the electrode groups 11 and 12 can also be formed by the following method. That is, a conductive layer is formed on the entire surface, a photoresist is coated on the conductive layer and patterned by photolithography, and the conductive layer is etched by using the patterned photoresist as a mask. The method of forming the electrode groups 11 and 12 is not limited to the method described above, and various methods can be applied.

In this case, the interval of the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) with respect to the electrodes $X_1$ and $X_2$, $X_3$ and $X_4$, $X_5$ and $X_6$, . . . is selected as the interval d described above. The interval between the electrodes $X_2$ and $X_3$, the interval between the electrodes $X_4$ and $X_5$, and the interval between the electrodes $X_6$ and $X_7$ are selected as the interval D, which is larger than the interval d. However, these intervals d and D, as described above, can be precisely set such that the electrodes X ($X_1$, $X_2$, $X_3$, . . . ) and the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) are formed with the same conductive layer by the same steps. However, these electrodes and the like can also be formed by conductive layers formed by different steps.

The height of the partition walls 18 is selected as a height at which the interval between the partition wall 18 and the dielectric layer 16 or the surface layer 17 formed on the surface of the dielectric layer 16 is set at an interval at which plasma discharge (to be described later) cannot be generated.

A filler gas pressure P in the flat spaces between the first and second substrates 1 and 2 can be set to be 0.3 to 5.0 atmospheric pressure.

The filler gas pressure P is selected such that, when a discharge start voltage $V_S$ is selected to be, e.g., the Paschen's minimum value according to Paschen's row, a product P•d between the filler gas pressure P and an inter-discharge-electrode distance, i.e., a distance (to be referred to as a distance between discharge electrodes hereinafter) between the electrodes X of rows, being planarly opposite to each other, for forming the plasma discharge portions P and the discharge electrode portions $I_Y$ is constant. However, when the discharge start voltage $V_S$ is selected to be, e.g., Paschen's minimum value, the distance d between the discharge electrodes can be varied within the range of ±10 s % with respect to the distance d determined at this time. Even if the discharge start voltage $V_S$ is set to be a value other than the Paschen's value, an allowance of about ±30% is permitted with respect to the inter-electrode distance d determined at this time.

The distance d between the discharge electrodes can be selected to be a narrow interval of 50 μm or less, e.g., 5 to 20 μm, 5 μm or less, 1 μm or less, or the like.

Figure 8A:
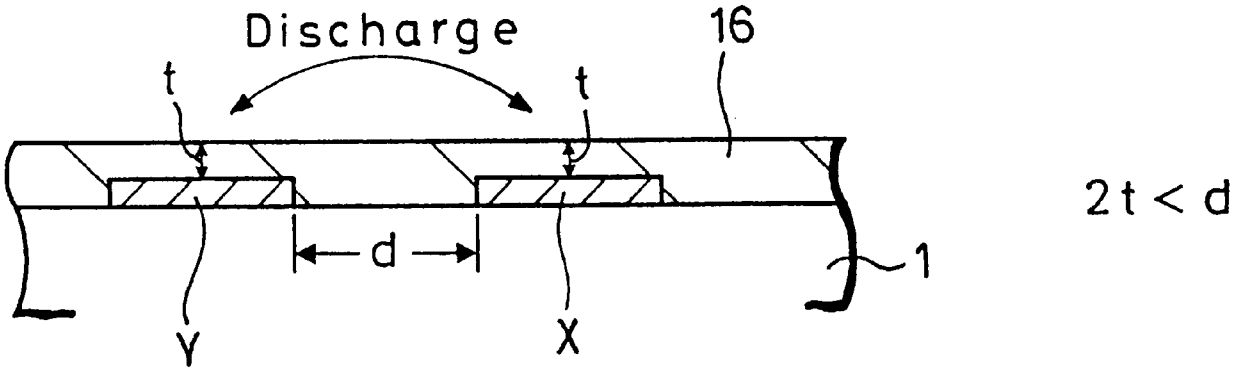
FIG. 8, consisting of FIGS. 8A through 8B, is an explanatory view of selection of a distance between discharge electrodes.
Figure 8B:
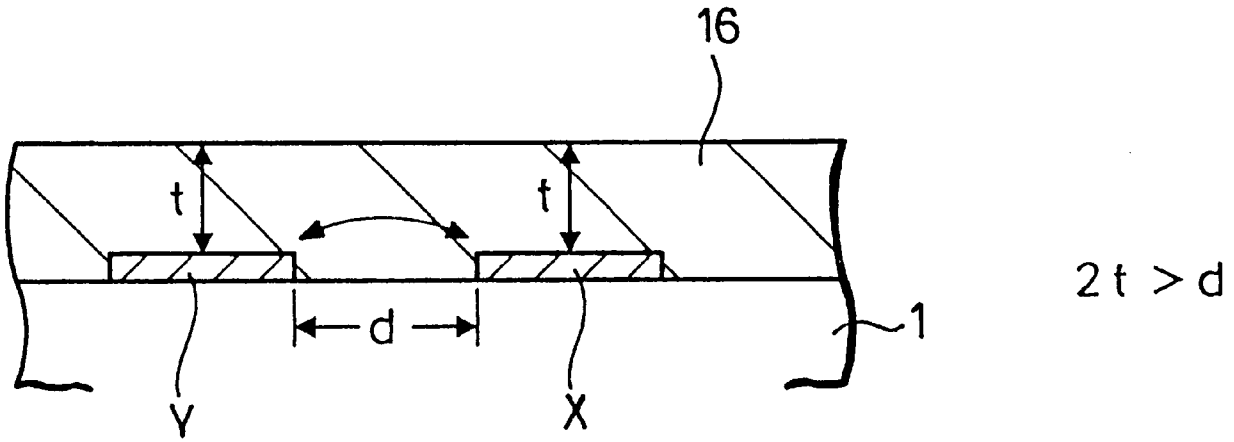

On the other hand, the distance d between the discharge electrodes must be selected in relation to a thickness t of the dielectric layer 16. More specifically, as shown in FIG. 8A as a discharge mode, in order to make plasma discharge above the dielectric layer 16, the plasma discharge must be made to pass through the dielectric layer 16 in the direction of thickness. As shown in FIG. 8B, in the dielectric layer 16, discharge must be avoided from being made between both the electrodes X and Y. For this purpose, if a dielectric constant of the surface layer 17 is sufficiently lower than that of the dielectric layer 16, the relationship $2t<d$ is preferably selected.

A drive method for the display device using the configuration will be described below.

One mode of the drive method will be described with reference to a voltage waveform chart in FIG. 9.

In this example, similar to a conventional plasma discharge display device, a discharge period is divided into the first-half portion and the second-half portion. The first-half portion is a scanning discharge period for determining discharge pixels, and the second-half portion is a maintaining discharge period in which a discharge is maintained to increase an emission luminance.

In this case, the start of a discharge is, only when the voltage of the discharge electrode portions $I_Y$ ($I_{Y11}$, $I_{Y12}$, $I_{Y13}$, . . . , $I_{Y31}$, $I_{Y32}$, $I_{Y33}$, . . . , $I_{Y51}$, $I_{Y52}$, $I_{Y53}$, . . . ) of the second electrode group 12 in the plasma discharge portions P, i.e., an applied voltage to the electrodes Y ($Y_1$, $Y_2$, $Y_3$, . . . ) represented by Va, and an applied voltage to the electrodes X ($X_1$, $X_2$, $X_3$, . . . ) of the first electrode group 11 represented by Vb are simultaneously applied, the plasma discharge portions P begin to generate discharge, i.e., the plasma discharge portions P are turned on. A voltage and a timing at which the discharge is generated can be set by the characteristics of the planar-type plasma discharge display device.

Figure 9:
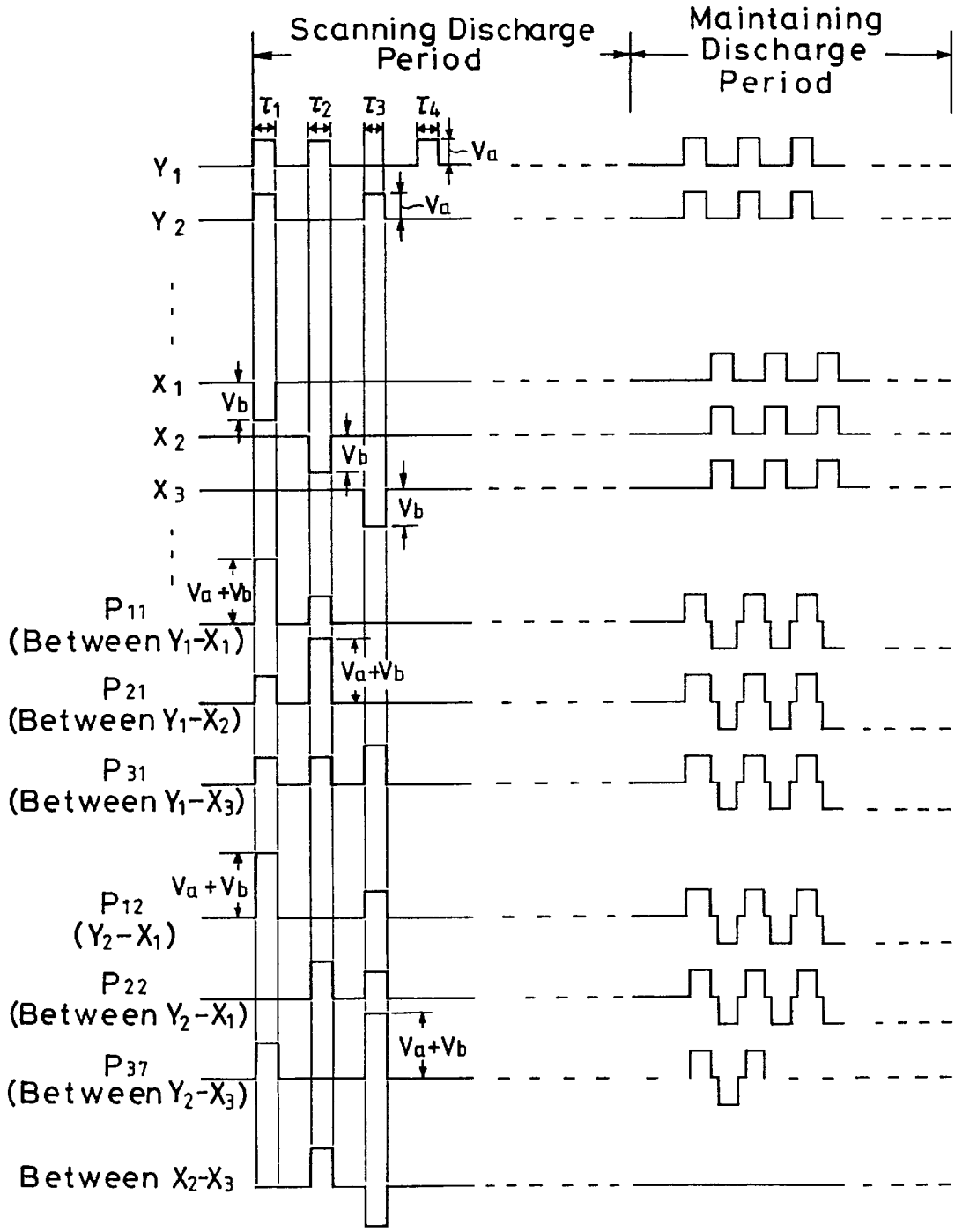
FIG. 9 is a drive waveform chart of an example of a drive method according to the present invention.

In the example shown in FIG. 9, in the scanning discharge period, the ON voltage Vb is sequentially applied to the electrodes $X_1$, $X_2$, $X_3$, . . . in constant sections $\tau_1$, $\tau_2$, $\tau_3$, . . . in a time-sharing manner. On the other hand, the On voltage Va depending on an image signal to be displayed is input to the electrodes $Y_1$, $Y_2$, $Y_3$, . . . .

In this manner, in the example in FIG. 9, a voltage Va+Vb is applied to the plasma discharge portions $P_{11}$ and $P_{12}$ in FIG. 4 formed between the ON-state electrode $X_1$ and the electrode $Y_1$ applied with the ON voltage Va of the image signal and between the ON-state electrode $X_1$ and the electrode $Y_2$ applied with the ON voltage Va of the image signal. For this reason, discharges are started in these plasma discharge portions $P_{11}$ and $P_{12}$.

Similarly, in the example in FIG. 9, the plasma discharge portion $P_{21}$ starts a discharge in the section $\tau_2$, and the plasma discharge portion $P_{32}$ starts a discharge in the section $\tau_3$.

In this case, as shown in FIG. 9, between the electrodes $X_2$ and $X_3$, $X_4$ and $X_5$, . . . which do not constitute the plasma discharge portions, a voltage of a voltage Va+Vb is not applied even in any sections $\tau$ ($\tau_1$, $\tau_2$, $\tau_3$, . . . ). For this reason, a discharge is not started between these electrodes.

Usually, in a maintaining discharge period, the plasma discharge portions which normally start discharges by applying a pulse voltage for maintaining a discharge to the electrodes X ($X_1$, $X_2$, $X_3$, . . . ) and Y ($Y_1$, $Y_2$, $Y_3$, . . . ) of the first and second electrode groups 11 and 12 can maintain the discharge state, i.e., emission state thereof.

In this manner, in the configuration of the present invention, switching is performed by each of the electrodes X ($X_1$, $X_2$, $X_3$, . . . ), and an image signal is applied to the electrodes Y ($Y_1$, $Y_2$, $Y_3$, . . . ), so that a display operation as that of a general matrix plasma discharge display device can be performed.

In addition, in the planar-type plasma discharge display device using the configuration of the present invention, in particular, when an interlace (interlaced scanning) method is applied, since a signal processing circuit for the interlace can be omitted, simplification of the drive circuit is achieved.

Figure 10:
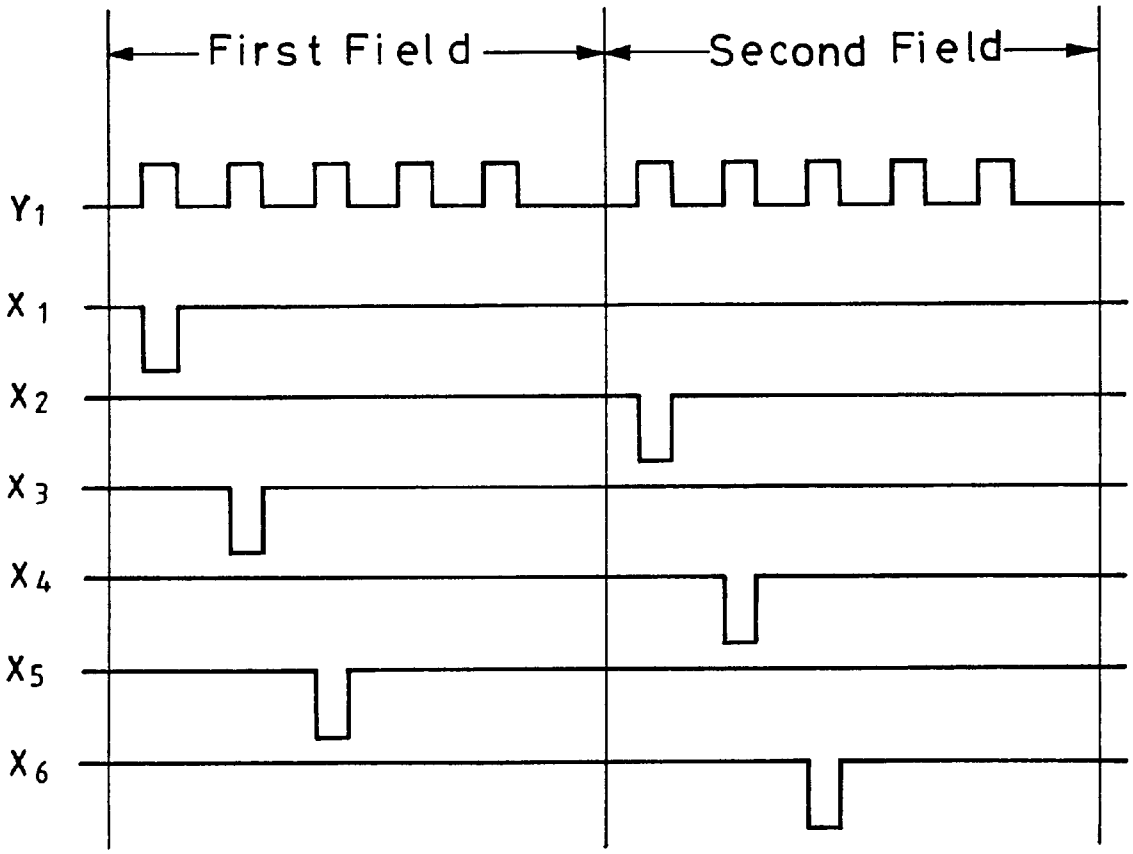
FIG. 10 is a drive waveform chart of another example of the drive method according to the present invention.
Figure 11:
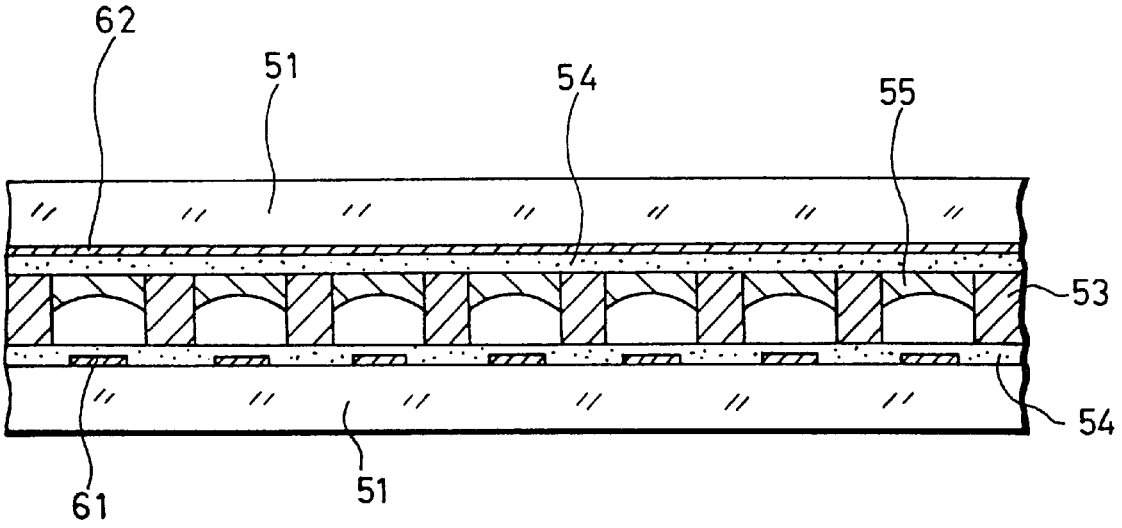
PRIOR ART FIG. 11
FIG. 11 is a sectional view of a conventional planar-type plasma discharge display device.
Figure 12:
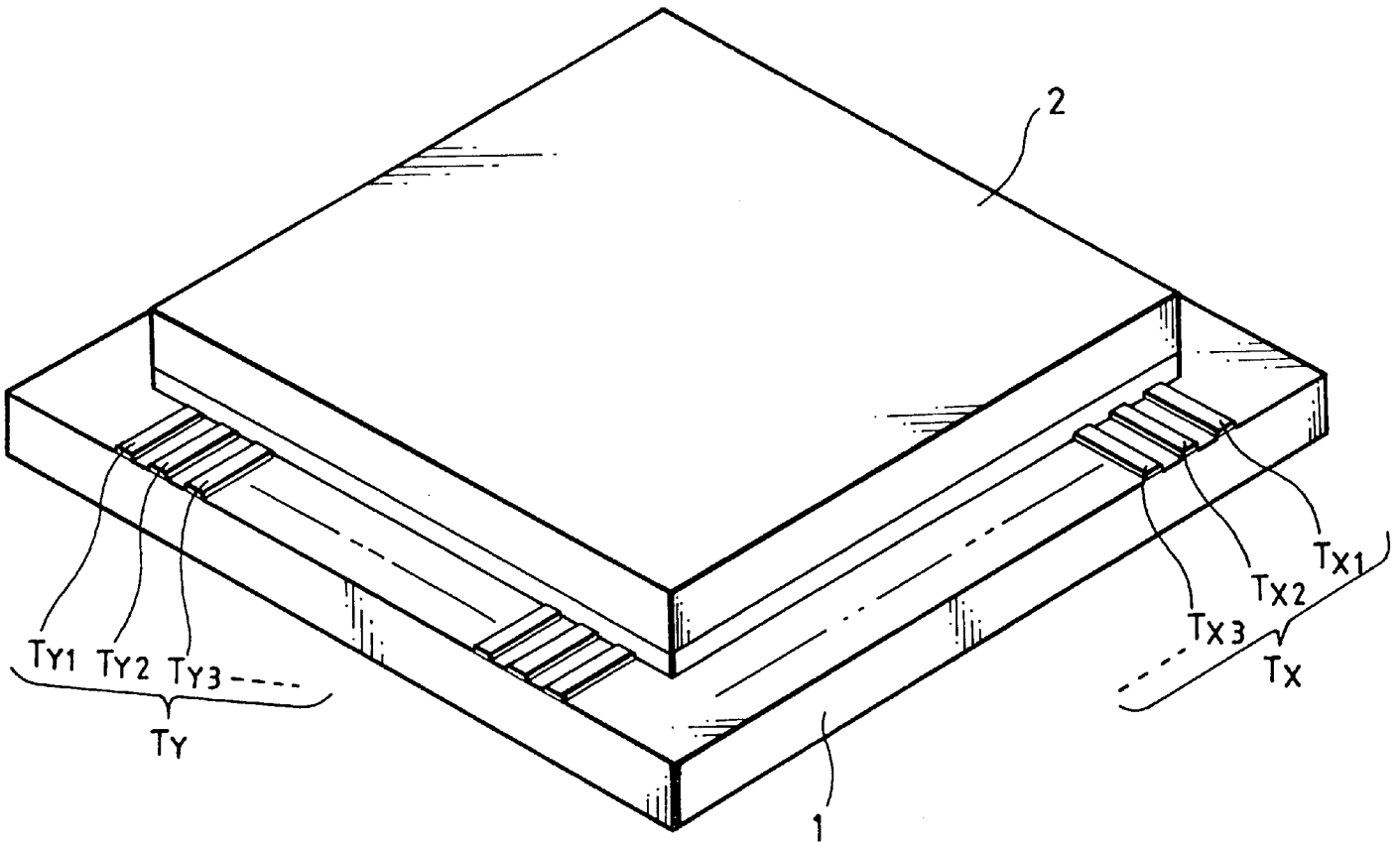
PRIOR ART FIG. 12
FIG. 12 is a perspective view of a planar-type plasma discharge display device to be compared with the device of the present invention.
Figure 13:
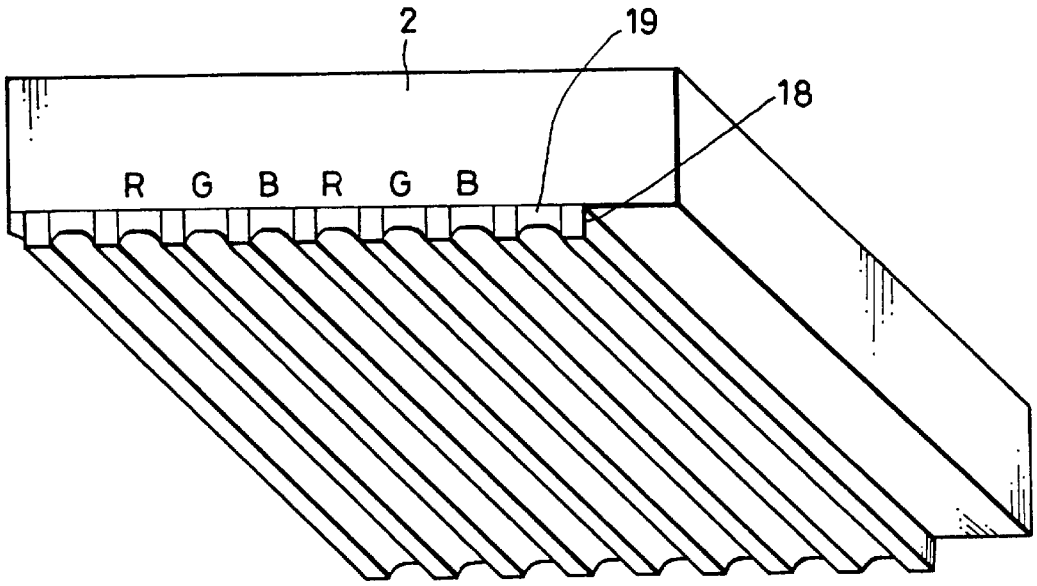
PRIOR ART FIG. 13
FIG. 13 is a partially cutaway open perspective view of an example of the planar-type plasma discharge display device shown in FIG. 12.
Figure 13:
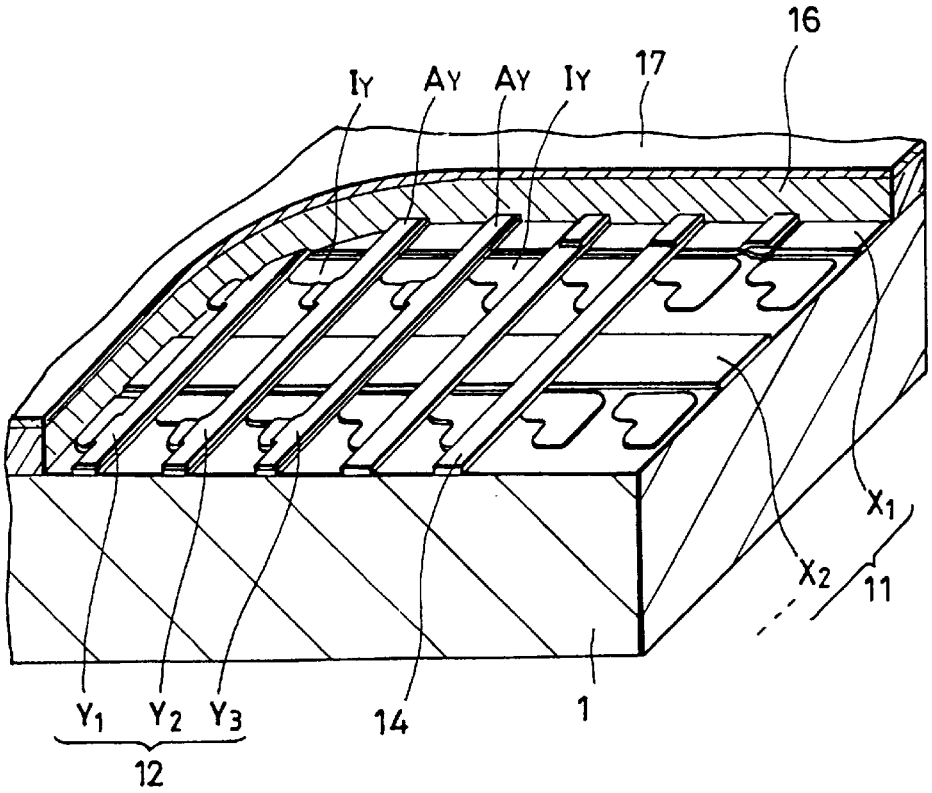
PRIOR ART FIG. 13

More specifically, in the planar-type plasma discharge display device using the configuration of the present invention, pairs of plasma discharge portions $P_{11}$ and $P_{21}$, $P_{12}$ and $P_{22}$, $P_{13}$ and $P_{23}$, . . . are constituted with respect to one discharge electrode portion $I_Y$. For this reason, in an interlace drive, one plasma discharge portions $P_{11}$, $P_{12}$, $P_{13}$, . . . , $P_{31}$, $P_{32}$, $P_{33}$, . . . of the pairs of plasma discharge portions are operated in the first field, and the other plasma discharge portions $P_{21}$, $P_{22}$, $P_{23}$, . . . , $P_{41}$, $P_{42}$, $P_{43}$, . . . of the pairs of plasma discharge portions are operated in the second field. As shown in FIG. 10 which is the drive waveform thereof, (with respect to an image signal, only the electrode Y1 is shown.) The electrodes $X_1$, $X_3$, $X_5$, . . . related to one plasma discharge portions $P_{11}$, $P_{12}$, $P_{13}$ . . . , $P_{31}$, $P_{32}$, $P_{33}$, . . . are sequentially turned on in the first field period, and the electrodes $X_2$, $X_4$, $X_6$, . . . related to the other plasma discharge portions $P_{21}$, $P_{22}$, $P_{23}$ . . . , $P_{41}$, $P_{42}$, $P_{43}$, . . . are sequentially turned on in the second field period.

In this manner, according to the device of the present invention, an interlace display can be performed without using any special signal processing circuit.

More specifically, in a recent general television (TV) broadcast, a video signal of an interlace broadcast is sent. Therefore, most of TV receives cope with the interlace broadcast, and package media apply to the interlace broadcast. In contrast to this, a display for a personal computer, a plasma display panel or the like basically uses a sequential scanning called progressive or non-interlace. When an interlace video image display is performed, the following method is employed. That is, image signals of one frame (two fields) are temporarily received and stored by the signal processing circuit, and the signals are sequentially extracted to perform a drive display. Actually, the image signals are held by using an element such as a semiconductor memory or the like, and the image signals are converted into the sequential scanning.

More specifically, when NTSC signals are displayed by a 480-line display, the display is performed by the following manner. That is, the transmission side sends two picture screens in one frame (30 MHz). One picture screen is information of 240 interlaced lines. Therefore, the display receives the two picture screens and then sequentially scans 480 lines. In a display which is represented by a liquid-crystal display and easily affected by flickers, when 30-Hz writing in which 480 lines are scanned only once in one frame is performed, a phenomenon such as a flicker or the like appears. For this reason, a method of displaying the same video image twice or a method of updating image information of every 240 lines at every field is employed. However, according the twice-writing method, the resolution of the image is degraded, and an unsharpened image is obtained. In any cases, in order to cause such a device to display a video signal of interlace signals, the signal processing circuit must have a memory function.

However, according to the display device of the present invention and the interlace drive method according to the present invention, such a memory function is not necessary. For this reason, a circuit configuration for a display is simplified.

According to each of the drive methods described above, when the pairs of plasma discharge portions P ($P_{11}$, $P_{112}$, $P_{13}$, . . . , $P_{21}$, $P_{22}$, $P_{23}$, . . . , $P_{31}$, $P_{32}$, $P_{33}$, . . . ) are independently caused to make discharge, i.e., when these plasma discharge portions are constituted as independent pixels, the emission luminance of these pairs of plasma discharge portions $P_{11}$ and $P_{21}$, $P_{12}$ and $P_{22}$, $P_{13}$ and $P_{23}$, . . . can be doubled by turning of each of these pairs at the same time. That is, in this case, the $X_1$ and $X_2$, $X_3$ and $X_4$, $X_5$ and $X_6$, . . . of the first electrode group 11 are simultaneously turned on, and the same information is displayed in the pairs of plasma display portions P.

An emission display by the planar-type plasma discharge display device according to the present invention is observed from the first substrate 1 side or the second substrate 2 side. In this case, at least the substrate 1 or 2 on the observed side is made of a transparent substrate which transmits the display emission light therethrough, for example, as described above, a glass substrate. However, when both the substrates 1 and 2 are made of a transparent substrate, if a light-reflecting film or a light-shielding film (not shown) such as an Al vapor deposition film or the like is formed on the inner surface of the substrate 2 or 1 opposing the observation side prior to formation of the electrode groups or the phosphor layers, the emission light is effectively guided to the observation side and the external incident light from the rear side can be shielded. For this reason, an improvement in contrast can be achieved.

When the emission display is observed from the first substrate 1 side on which the electrode groups are formed, the electrodes of the first and second electrode groups 11 and 12 are constituted by a transparent conductive layer, e.g., ITO (complex oxides of In and Sn).

The planar-type plasma discharge display device and the drive method according to the present invention are not limited to the examples described above. Various modifications and changes can be effected. For example, an image signal to be displayed may be input to the electrodes X ($X_1$, $X_2$, $X_3$, . . . ) of the first electrode group 11, and a switching drive may also be performed by the electrodes Y ($Y_1$, $Y_2$, $Y_3$, . . . ) of the second electrode group 12.

The shape of, e.g., the discharge electrode portion $I_Y$ is square in the illustrated example, and the two opposite sides thereof are opposite to the pair of electrodes X. However, its shape can be made as a polygonal shape and an elliptical shape. In addition, the opposite portion of the electrode X and the discharge electrode portion $I_Y$ is not limited to a side surface in an extending direction of the electrode X, e.g., a row direction (horizontal direction). For example, as a pattern having an extending portion extending from, e.g., the extending direction of the electrode X, e.g., a row direction (horizontal direction) to a column direction (vertical direction), the plasma discharge portion P can be constituted by using this extending portion as a portion opposite to the discharge electrode portion $I_Y$.

As a display method, the method using phosphor emission in the example described above is used. However, a configuration in which a display is performed by discharge emission itself may be used, and various modifications and changes can be effected.

For example, in the example described above, the electrodes X of the first electrode group 11 and the discharge electrode portions $I_Y$ of the electrodes Y of the second electrode group 12 are formed with the same conductive layer by the same steps. However, the discharge electrode portions $I_Y$ of the electrodes Y of the second electrode group 12 and the electrode portions $A_Y$ which perform a so-called power supply can be constituted with the same conductive layer by steps different from those of the first electrode group 11. More specifically, in this case, after only the electrodes X of the first electrode group 11 are formed, the insulating layer 14 is formed. Thereafter, the electrode portions $A_Y$ of the electrodes Y of the second electrode group 12 and the discharge electrode portions $I_Y$ extended therefrom can be formed. In this case, the connection pieces 15 are omitted.

When a DC drive configuration is employed, the dielectric layer 16 and the surface layer 17 are not formed. In case of the DC discharge, usually, the electrodes on the cathode side are oxidized by the discharge, while the electrodes on the anode side are reduced. For this reason, the electrodes constituting the first or second electrode group 11 or 12 on the cathode side are made of a metal oxide, e.g., ITO, $SnO_2$, $In_2O_3$ or the like, and the electrodes constituting the second or first electrode groups 12 or 11 on the anode side are made of, e.g., Al, Cu, Ni, Fe, Cr, Zn, Au, Ag, Pb, or the like of a metal electrode or an alloy of one or more types of these metals.

Therefore, in this case, the first electrode group 11 and the second electrode group 12 are not preferably constituted by the same conductive layer. In this case, the electrode portions $A_Y$ and the discharge electrode portions $I_Y$ of the electrodes Y of the second electrode group 12 are constituted by the same conductive layer.

In either one of the AC drive and the DC drive, when, e.g., the electrodes X of the first electrode group 11 are constituted by oxide electrodes such as transparent electrodes or the like, the resistivity of the oxide electrodes is generally high. For this reason, in this case, a conductive layer made of Al, Ni, Cu, or the like and having excellent conductivity is preferably adhered to one-side edge thereof extending along the belt-like electrodes in the row direction of the belt-like electrode.

According to the planar-type plasma discharge display device using the configuration of the present invention, the first and second electrode groups 11 and 12 serving as respective discharge electrodes are formed on the common substrate, i.e., the first substrate 1 constituting the flat vessel in the example described above. For this reason, the intervals between the electrodes can be correctly set. Therefore, a stable display device having a preferably high precision can be easily manufactured.

As described above, since the first and second electrode groups 11 and 12 serving as the respective discharge electrodes are formed on the common substrate, the distance d between the discharge electrodes and an interval between the discharge electrodes when the discharge electrodes are formed on opposite substrates, i.e., a discharge space and the like are avoided from being restricted each other, and the degree of freedom of selection thereof is high. Design and manufacturing of the display device can be simplified.

Since the discharge electrodes and the phosphor layers are formed on the different substrates 1 and 2, formation of the phosphors need not be formed at limited positions except for the electrode forming portions. The phosphor can be formed on portions opposing the electrodes, i.e., not only the side surfaces of the partition walls 18 but also the bottom surfaces of the partition walls 18, so that a luminance can be improved.

As has been described above, according to the configuration of the present invention, since the discharge electrodes and the phosphors are formed on the different substrates 1 and 2, the coating area of the phosphors, as described at the beginning, is considerably larger as compared with the case of the discharge electrodes and the phosphors that are formed on the same substrate, and hence a high luminance can be achieved.

In addition, according to the configuration of the present invention, since the first and second electrode groups 11 and 12 serving as discharge electrodes are formed on the common substrate, i.e., the first substrate 1 constituting the flat vessel in the example described above, the intervals between these electrodes can be correctly set.

In addition, when a color display device on which a phosphor layer is formed is constituted, the substrate on which the phosphor layer is formed is different from the substrate on which the first and second electrode groups 11 and 12 are formed. For this reason, the color display device is easily manufactured, and mass-productivity thereof is improved. In addition, characteristic degradation that the electrode groups and the phosphors are damaged to each other in formation of the electrode groups and the phosphors is avoided. For this reason, an improvement in yield is achieved.

Since the first and second electrode groups 11 and 12 serving as the discharge electrodes are formed on the common substrate, the interval d between the electrodes X and Y constituting the discharge electrodes and a discharge space, i.e., the interval between the first and second substrates 1 and 2, and the like are avoided from being limited to each other, and the degree of freedom of selection thereof becomes high. Design and manufacturing of the display device can be simplified. Highly reliable display devices can be easily manufactured with good workability, so that the mass-productivity of manufacturing can be achieved.

According to the planar-type plasma discharge display device using the configuration of the present invention, since two plasma discharge portions are formed for one of the discharge electrode portions $I_Y$ of the second electrode group 12, an increase in number of plasma discharge portions, i.e., an increase in number of pixels and a high density can be achieved without decreasing the widths of the electrodes. Therefore, a high-quality and high-definition display can be performed.

When the widths of the respective electrodes are decreased, a higher density and a reduction in size can be achieved.

According to the display drive method according to the present invention, the display can be performed without any erroneous operation.

In particular, since a signal processing circuit having a memory function is not required in case of an interlace system, a circuit configuration can be simplified.

Since the pairs of plasma discharge portions can be simultaneously operated, a high-luminance display can be performed.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A planar-type plasma discharge device characterized in that:

first and second electrode groups each formed by planarly arraying a plurality of electrodes are planarly arranged on a common electrode such that an insulating layer is interposed between crossing portions of the electrodes; and a common discharge electrode portion, which is provided on each electrode of the second electrode group, is arranged between electrodes of respective adjacent pairs of the first electrode group with a required narrow interval with respect to the pair of electrodes to form plasma discharge portions at opposite portions of the discharge electrode portion to the pairs of electrodes.

2. A planar-type plasma discharge display device according to claim 1, characterized in that a partition wall insulating layer is interposed between electrodes of the first and second electrode groups which are directly adjacent to each other without interposing the discharge electrode portion therebetween.

3. A planar-type plasma discharge display device according to claim 1, characterized in that a partition wall insulating layer with a height larger than an interval between the electrodes is interposed between electrodes of the first and second electrode groups which are directly adjacent to each other without interposing the discharge electrode portion therebetween.

4. A planar-type plasma discharge display device according to claim 1, characterized in that a partition wall insulating layer is interposed between electrodes of the first and second electrode groups which are directly adjacent to each other without interposing the discharge electrode portion therebetween; and the partition insulating layer and the insulating layer interposed between the crossing portions of the electrodes of the first and second groups are constituted by a common insulating layer to have a shape of a lattice-like pattern as a whole.

5. A planar-type plasma discharge display device according to claim 1, characterized in that a first substrate and a second substrate are opposite to each other with a required interval, and peripheral portions of the first and second substrates are airtightly sealed to each other to thereby constitute a planar display vessel;

at least one of the first substrate and the second substrate is constituted by a transparent substrate which transmits therethrough a display light; and the first substrate is made as the common electrode on which the first and second electrode groups are formed.

6. A planar-type plasma discharge display device according to claim 1, characterized in that a first substrate and a second substrate are opposite to each other with a required interval, and peripheral portions of the first and second substrates are airtightly sealed to each other to thereby constitute a planar display vessel;

at least one of the first substrate and the second substrate is constituted by a transparent substrate which transmits therethrough a display light;

the first substrate is made as the common electrode on which the first and second electrode groups are formed; and a phosphor layer is formed on the second substrate.

7. A planar-type plasma discharge display device according to claim 1, characterized in that a first substrate and a second substrate are opposite to each other with a required interval, and peripheral portions of the first and second substrates are airtightly sealed to each other to thereby constitute a planar display vessel;

at least one of the first substrate and the second substrate is constituted by a transparent substrate which transmits therethrough a display light;

the first substrate is made as the common electrode on which the first and second electrode groups are formed; and a partition wall for dividing a unit discharge region is formed on the second substrate.

8. A planar-type plasma discharge display device according to claim 1, characterized in that a dielectric layer is entirely formed on the first and second electrode groups.

9. A planar-type plasma discharge display device according to claim 1, characterized in that a dielectric layer is entirely formed on the first and second electrode groups; and when a thickness of the dielectric layer is represented by t, and an interval between the discharge electrode portion and the electrodes of the first electrode group which constitute the plasma discharge portion is represented by d, $2t<d$ is satisfied.

10. A planar-type plasma discharge display device according to claim 1, characterized in that a dielectric layer is entirely formed on the first and second electrode groups, and a surface layer for decreasing a discharge voltage having a work function smaller than that of the dielectric layer is formed on the dielectric layer.

11. A planar-type plasma discharge display device according to claim 1, characterized in that a dielectric layer is entirely formed on the first and second electrode groups, and a surface layer having sputter resistance property is formed on the dielectric layer.

12. A drive method for a planar-type plasma discharge display device in which first and second electrode groups each formed by planarly arraying a plurality of electrodes planarly are arranged on a common electrode such that they are crossed through an insulating layer; and a common discharge electrode portion is arranged between electrodes of adjacent pairs of the first electrode group to form plasma discharge portions at opposite portions between the discharge electrode portions and the pairs of electrodes, respectively, characterized in that a target display is performed to apply a voltage which is equal to or higher than a discharge start voltage across the electrodes of the first electrode group and the discharge electrode portion of the second electrodes constituting a selected plasma discharge portion.

13. A drive method for a planar-type plasma discharge display device according to claim 12, in which one frame is constituted by first and second fields when a target display is performed to apply the voltage which is equal to or higher than the discharge start voltage between the electrodes of the first electrode group and the discharge electrode portion of the second electrodes constituting the selected plasma discharge portion, characterized in that a display by one plasma discharge portion of a pair of plasma discharge portions constituted by the discharge electrode portions is performed in the first field; and a display by the other plasma discharge portion of the pair of plasma discharge portions constituted by the discharge electrode portions is performed in the second field.

14. A drive method for a planar-type plasma discharge display device according to claim 12, characterized in that when a target display is performed to apply the voltage which is equal to or higher than the discharge start voltage between the electrodes of the first electrode group and the discharge electrodes portion of the second electrodes constituting the selected plasma discharge portion, a pair of plasma discharge portions constituted by the discharge electrode portions are simultaneously subjected to a driving discharge to perform a display.

* * * * *